United States Patent [19]

La Fever

[11] 4,387,527

[45] Jun. 14, 1983

[54] GUN SAFETY

[75] Inventor: Clifford E. La Fever, Mission Viejo, Calif.

[73] Assignee: The United States of America as represented by the Secretary of the Army, Washington, D.C.

[21] Appl. No.: 241,911

[22] Filed: Mar. 9, 1981

[51] Int. Cl.[3] ..... F41C 17/00

[52] U.S. Cl. ..... 42/70 R

[58] Field of Search ..... 42/70 R; 89/138

[56] References Cited

U.S. PATENT DOCUMENTS 1,247,528 11/1917 Hammond ..... 89/138

1,324,493 12/1919 Burton ..... 42/70 R

*Primary Examiner*—Charles T. Jordan

*Assistant Examiner*—Ted L. Parr

*Attorney, Agent, or Firm*—Robert P. Gibson; Anthony T. Lane; A. Victor Erkkila

[57] ABSTRACT

A safety for a gun has a manually operable member and a catch. The gun has a frame supporting a longitudinally reciprocatable bolt and a sear operable to engage and restrain the bolt. The manually operable member is mounted on the frame to reciprocate between the safe and the fire position. The catch, mounted on the member, is positioned to engage and restrain the bolt when the member is in the safe position.

2 Claims, 4 Drawing Figures

FIG. 1
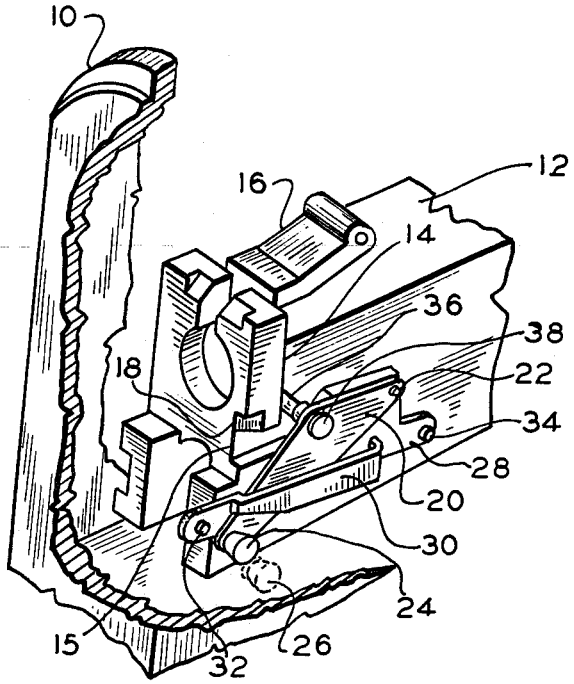
FIG. 2
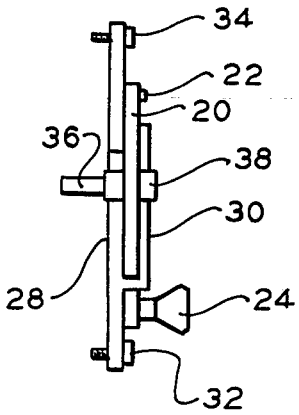
FIG. 3
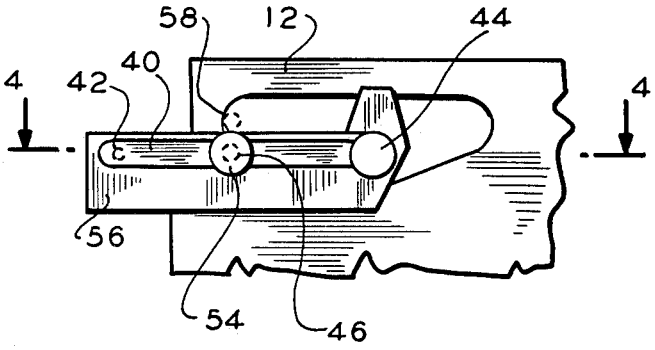
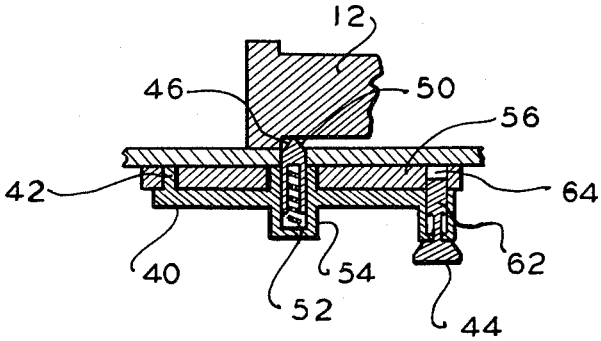
FIG. 4

GUN SAFETY

GOVERNMENT INTEREST

The invention described herein may be manufactured, used and licensed by or for the Government, for Governmental purposes without the payment to me of any royalties hereon.

BACKGROUND OF THE INVENTION

The present invention relates to gun safeties and, in particular, to a safety for engaging and restraining a gun bolt.

Known safeties have included a disabling mechanism which operates directly on a trigger or on a sear that holds the gun bolt in a retrogressed position. This type of disabling mechanism may be required to sustain damaging shocks if it is shifted to a safe position when its bolt is in a forward position, because continuing motion of the bolt may possibly jam the gun. Moreover, these mechanisms have no provision for preventing the gun from accidentally firing when the safety is released.

Thus it is desirable to have a simple and reliable safety which allows a sear to fully engage and restrain the gun bolt notwithstanding that the trigger may be manipulated while the safety is on. It is important that the safety allow resetting of the sear so that the gun does not accidentally fire when the safety is released.

SUMMARY OF THE INVENTION

In accordance with the illustrative embodiments demonstrating features and advantages of the present invention, there is provided a safety for a gun. This gun has a frame supporting a longitudinally reciprocatable bolt and a sear operable to engage and restrain the bolt. The safety has a manually operable member and a catch. The manually operable member is mounted on the frame to reciprocate between a safe and a fire position. The catch is mounted on the member and is positioned to engage and restrain the bolt when the member is in the safe position.

By employing such apparatus a relatively simple safety is provided which allows a reciprocatable bolt to fully retrogress after the safety is operated, without jamming the gun. Also, because the safety itself engages the bolt, the load otherwise applied to the sear is removed. This allows the sear to reset should it be moved by inadvertant manipulation of the trigger. Such a safety can be operated under virtually any conditions: while the gun is charged, on sear, when the bolt is closed or when the weapon is firing. This feature is also significant since an automatically firing weapon may have a malfunction causing it to continue firing. The present safety can prevent this runaway condition.

In a preferred embodiment, actuating the safety mechanism to render the gun inoperable causes the bolt to retract 0.02 inch from the sear. This feature unloads the sear and allows it to reset if disturbed so that the bolt will stay restrained when the safety is released, thus preventing accidental firing.

In one embodiment, the safety has a spring loaded plunger mounted on a lever. The plunger can be moved into a safe position where it can extend in front of a shoulder on the bolt, preventing it from moving forward. In this embodiment, either the plunger or the rear face of the bolt may be beveled so that the bolt may retrogress past the plunger, causing it to retract. After the shoulder of the bolt passes, the plunger extends in front of the shoulder preventing the bolt from moving forward. In this embodiment, the lever carrying the plunger can be rotated to bring the plunger in line with a groove in the bolt so that the plunger neither engages nor restrains the bolt.

BRIEF DESCRIPTION OF THE DRAWINGS

The above brief description as well as other objects features and advantages of the present invention will be more fully appreciated by reference to the following detailed description of presently preferred but nonetheless illustrative embodiments in accordance with the present invention when taken in conjunction with the accompanying drawings wherein:

FIG. 1 is a perspective view of a safety for a gun, according to the present invention;

FIG. 2 is a plan view of the safety of FIG. 1;

FIG. 3 is a side view of a safety which is an alternate of that of FIG. 1; and FIG. 4 is a sectional view along lines 4—4 of FIG. 3.

DETAILED DESCRIPTION OF THE PREFERRED EMBODIMENT

Referring to FIG. 1, a gun has frame 10 slidably supporting bolt 12. Bolt 12 is illustrated in a retrogressed position. Bolt 12 has an enlarged, rectangular, rear block forming a forward shoulder 14. Pivotally mounted in frame 10 is conventional sear 16 shown pressed on top of bolt 12 by a spring (not shown) to restrain the bolt. The specific mounting hardware for sear 16 was not shown to clarify the illustration. Bolt 12 has cut into its aft end, slanted face 18 which performs a function described hereinafter.

A manually operable member of a safety is shown herein as lever 20 which, in this embodiment, is shaped as an oblique triangle and is attached at its forward end by pivot 22. The aft of lever 22 includes handle 24. Lever 20 is illustrated herein in its safe position. If handle 24 were pushed downward to position 26, shown in phantom, lever 20 would be in a fire position.

Lever 20 is mounted through pivot 22 to carrying frame 28, a plate having the general shape of an inverted T. Carrying frame 28 has a guard 30 encircling lever 20 and restricting the extent to which it can rotate. Carrying frame 28 is mounted onto frame 10 by machine screws 32 and 34.

A catch of the safety is shown herein as plunger (or piston) 36 mounted in cylindrical holder 38. Plunger 36 is illustrated in its extended position in front of shoulder 14, thereby restraining forward motion of bolt 12. Plunger 36 is urged into an extended position by a resilient means such as an internal compression spring (illustrated hereinafter for another embodiment).

Referring to FIG. 2, a plan view is given of the safety of FIG. 1 but removed from the gun.

Referring to FIGS. 3 and 4, an alternate embodiment of a safety is illustrated. Manually operable member 40 is mounted at its aft end through pivot 42. Rotation of member 40 is accomplished by handle 44 on member 40. A catch similar to that of FIGS. 1 and 2 is shown herein as plunger 46 having slanted surface 50. The previously mentioned resilient means is shown herein as compression spring 52 which is held between plunger 46 and cylindrical holder 54 formed in member 40.

Handle 44 is shown as part of a locking mechanism and has at its inside end cylindrical locking bolt 62 which engages corresponding aperture 64 in carrier plate 56. Carrier plate 56 is mounted to the associated gun frame in a manner similar to the mounting of plate 28 of FIG. 1. It is to be appreciated that handle 44 may be urged into the illustrated position by a compression spring encircling the center stem of handle 44.

Bolt 12, similar to the one previously illustrated, is shown positioned so that plunger 46 can engage shoulder 58 of bolt 12. Bolt 12 can retrogress against slanted surface 50 causing plunger 46 to retract. After bolt 12 reaches the illustrated position, plunger 46 reprojects itself as shown.

In FIG. 3, member 40 is in the fire position. Thus positioned, plunger 46 is aligned with a groove (not shown) in gun bolt 12. If handle 44 is lifted upwardly, plunger 46 moves upward to engage shoulder 58 of bolt 12. In moving upwardly, plunger 46 can drive bolt 12 backwards to unload its sear (previously illustrated). In a preferred embodiment, this backward travel amounts to 0.02 inch.

To facilitate an understanding of the principles associated with the present invention, the operation of the apparatus of FIGS. 1 and 2 will be briefly described. It will be appreciated, however, that the operation of the apparatus of FIGS. 3 and 4 is substantially indentical.

With the gun in the condition illustrated in FIG. 1, firing is not possible since bolt 12 is held in place. It is clear that bolt 12 cannot move forward since plunger 36 is extended in front of shoulder 14.

Handle 24 is now downwardly depressed to pivot lever 20, moving plunger 36 downward. Member 20 may be rotated until it engages the forward, inside surface of guard 30. Once repositioned in this manner, plunger 36 is aligned with groove 15 in bolt 12. Accordingly, bolt 12 is free to reciprocate as plunger 36 passes through groove 15 without interference.

It will now be assumed that bolt 12 has moved forward and that lever 20 is then rotated back to its initial position. Next, bolt 12 retracts attempting to fire another round. As bolt 12 retracts, slanted face 18 engages plunger 36. A camming action occurs which forces plunger 36 into holder 38, allowing bolt 12 to continue backwardly. Once shoulder 14 passes plunger 36, the latter again extends in front of the shoulder. Once extended, plunger 36 holds bolt 12 in its retrogressed position, preventing firing of the gun. It is also to be appreciated that the restraining force on bolt 12 is provided by plunger 36, no load being sustained by sear 16. Thus, sear 16 will fall to the illustrated position and will return there even if disturbed by inadvertent manipulation of a trigger (not shown).

It will now be assumed that prior to moving lever 20 upward into a safe position, bolt 12 retrogressed and was engaged and restrained by sear 16. Lever 20 is now rotated by moving handle 24 upwardly causing plunger 36 to engage shoulder 14 and move bolt 12 backwards approximately 0.02 inch, thereby unloading sear 16.

It is to be appreciated that various modifications may be implemented with respect to the above described preferred embodiments. For example, the manually operable member, instead of pivoting, may be mounted to allow longitudinal motion, outward motion, transverse motion, or combinations thereof. Also, in some embodiments alternate catches may be employed such as a conventional pawl. Furthermore, the shapes and outlines of the various components illustrated herein may be altered to fit the available space in the associated weapon. In addition, while moving parts are illustrated mounted on a manually operable member, in other embodiments the relationship may be reversed so that the movable parts are mounted on the bolt. It is also expected that various locking mechanisms may be employed to keep the manually operable member in one or more predetermined positions. Also, the mechanisms illustrated herein may be fabricated from various metals or other materials to satisfy the desired strength, speed, durability, load etc.

Obviously modifications and variations of the present invention are possible in light of the above teachings. It is therefore to be understood that within the scope of the appended claims this invention may be practiced otherwise than as specifically described.

What is claimed is:

1. A safety for a gun having a frame supporting a longitudinally reciprocatable bolt and a sear operable to engage and restrain said bolt, said safety comprising:

a manually operable member mounted on said frame to reciprocate between a safe and a fire position; and a catch mounted on said member and positioned to engage and restrain said bolt when said member is in said safe position and operable to restrain said bolt as it reaches a retrogressed position;

wherein said bolt has a shoulder and a slanted face on a side of said bolt opposite said shoulder and wherein said catch is mounted to reciprocate between a retracted and an extended position, said bolt being backwardly moveable to cause said shoulder to engage said catch, causing it to retract and then extend as said bolt reaches said retrogressed position.

2. A safety for a gun having a frame supporting a longitudinally reciprocatable bolt and a sear operable to engage and restrain said bolt, said safety comprising:

a manually operable member mounted on said frame to reciprocate between a safe and a fire position; and a catch mounted on said member and positioned to engage and restrain said bolt when said member is in said safe position and operable to restrain said bolt as it reaches a retrogressed position;

wherein said bolt has a shoulder and wherein said catch is mounted to reciprocate between a retracted and an extended position and comprises a plunger operable to extend in front of said shoulder, said bolt being backwardly moveable to cause said shoulder to engage said catch, causing it to retract and then extend as said bolt reaches said retrogressed position, wherein said plunger has a slanted surface positioned to engage said bolt causing it to drive said plunger away from said bolt as said bolt retrogresses.

* * * * *